United States Patent [19]

Soble

[11] Patent Number: 4,666,153

[45] Date of Patent: May 19, 1987

[54] APPARATUS FOR SELF-MANIPULATION OF A SPINAL VERTEBRAE

[76] Inventor: Irwin F. Soble, P.O. Box 5660, Yuma, Ariz. 85364

[21] Appl. No.: 718,236

[22] Filed: Apr. 1, 1985

[51] Int. Cl.[4] ..... A63B 21/00

[52] U.S. Cl. ..... 272/144; 272/93

[58] Field of Search ..... 272/93, 109, 120, 121, 272/126, 144, 145, 900; 128/71, 75, 68, 69, 134, 135

[56] References Cited

U.S. PATENT DOCUMENTS

| | | | |
|---|---|---|---|
| 1,721,709 | 7/1929 | Odell | 272/144 |
| 3,524,643 | 8/1970 | Hazelitt, Sr. | 272/900 |
| 3,947,023 | 3/1976 | Martin | 272/93 |
| 4,102,336 | 7/1978 | Wiener et al. | 272/75 |
| 4,198,044 | 4/1980 | Holappa | 272/144 |

FOREIGN PATENT DOCUMENTS

| | | | |
|---|---|---|---|
| 2491341 | 4/1982 | France | 272/144 |

*Primary Examiner*—Richard J. Apley
*Assistant Examiner*—S. R. Crow
*Attorney, Agent, or Firm*—Harry M. Weiss & Associates

[57] ABSTRACT

An improved exercise apparatus for permitting a user to perform a manipulative adjustment maneuver known in the fields of chiropractics and orthopedics as the "lumbar roll" for opening the intervertebrae spaces to spontaneously permit the adjustment and proper positioning of the user's vertebrae relative to each other. Vertical support means are connected to the upper portion of a frame having a body engaging panel. A holddown means is removably mounted on the vertical support means to properly secure the upper torso of a user to the frame. At least one securing means is coupled to the lower portion of the frame to permit the user's legs to be secured thereto. The user can thereafter grasp a long horizontal lever to properly apply appropriate pressure during the user's performance of the "lumbar roll" by rotating his lower torso in one direction. Alternatively, by grasping the long horizontal lever, the user is able to apply appropriate pressure upon himself to rotate his lower torso or pelvis in one direction while rotating his upper torso in the opposite direction, if desired.

9 Claims, 6 Drawing Figures

APPARATUS FOR SELF-MANIPULATION OF A SPINAL VERTEBRAE

BACKGROUND OF THE INVENTION

1. Field of the Invention

This invention generally relates to an exercise apparatus having posts protruding above a rectangular frame. Two of these posts, located at one end of the apparatus, can support a horizontal extension which extends across the width of the apparatus as a holddown device of a user's upper torso. A post is located at the other end of the apparatus acting as a support means for permitting pressure to be applied to the user's legs for creating sufficient twisting motion and stretching of the back muscles. The twisting motion simulates a chiropractic and orthopedic maneuver known as the "lumbar roll" which allows the repositioning of the spinal vertebrae in order to relieve pain in the back.

2. Description of the Relevant Art

It is a well known fact that back problems can be extremely uncomfortable, if not excruciatingly painful. Back problems can occur due to misalignment and improper positioning of the vertebrae relative to each other. A manipulative adjustment maneuver known in the fields of chiropractics and orthopedics as the "lumbar roll" is a means for opening the intervertebral spaces to spontaneously permit the alignment and proper positioning of the vertebrae relative to each other. The "lumbar roll" is performed by holding down the upper torso (specifically, the shoulders) while rotating the pelvis in one direction. Alternatively, the "lumbar roll" is achieved by rotating his pelvis in one direction while rotating his upper torso (specifically, the shoulders) in the opposite direction, if desired. Normally, this maneuver cannot be performed by oneself due to the necessity in applying pressure to the portions of the body that need to be either held down or rotated. Other persons are thus essential to assist in order to properly perform the maneuver. Absense of any assistance, multiple attempts to perform the "lumbar roll" can be an exhausting and uncomfortable process, especially if the person is already suffering from back pains.

It is known in the related art that a torso-centric excercise board (as disclosed in U.S. Pat. No. 3,947,023) employs handgrips in the form of a post on a flatten base which supports a crossbar above the floor. One of the disadvantages of the mere use of posts as handgrips is the absence of a holddown device upon which the upper torso can be effectively held to properly perform the body twisting motions. Moreover, utilizing the posts merely for handgrips denies the user from properly securing his legs to more effectively perform the body twisting exercise. Accordingly, the lack of a means for holding down the upper torso and means for securing the legs would not permit the user to properly and effectively perform the "lumbar roll" for self-manipulation of his spinal vertebrae.

A need has therefore been felt to provide an improved apparatus for properly and efficiently permitting a person to perform a body twisting motion known as the "lumbar roll" for self manipulation of his spinal vertebrae.

It is an object of the present invention to provide an improved apparatus for self-manipulation of a spinal vertebrae that can effectively holddown the upper torso of the user to permit him to perform the necessary twisting motion known as the "lumbar roll."

It is still another object of the present invention to provide an improved apparatus for self-manipulation of a spinal vertebrae that can permit the user to properly secure his legs to permit him to perform the necessary twisting motion known as the "lumbar roll."

It is yet another object of the present invention to provide an improved apparatus for self-manipulation of a spinal vertebrae that can permit the user to properly balance himself during his performance of the twisting motion known as the "lumbar roll".

It is a further object of the present invention to provide an improved apparatus for self-manipulation of a spinal vertebrae that can be effectively disassembled for easy storage when not in use.

It is a further object of the present invention to provide an improved apparatus for self-manipulation of a spinal vertebrae which can be easily and economically produced, yet sturdy in construction and highly efficient in operation.

It is a further object of the present invention to provide an improved apparatus for self-manipulation of a spinal vertebrae which is constructed with extreme simplicity, embodying simple removable parts, and therefore capable of being retailed for a low price, long lasting in use, and convenient to use.

SUMMARY OF THE INVENTION

The aforementioned and other objects of the present invention are accomplished by providing an apparatus for self-manipulation of a spinal vertebrae having a plurality of posts at the upper portion to preferably permit a holddown bar to be removably mounted thereto. Moreover, a post attached to the lower portion of the apparatus permits a user to properly secure his legs to effectively perform the twisting motion essential to accomplish the "lumbar roll" for self-manipulation to the user's spinal vertebrae. By further providing a lever which extends along the length of the apparatus, the user can properly apply the necessary pressure to himself during the exercise maneuvers executing the "lumbar roll" by being able to rotate his pelvis in one direction while rotating his shoulders in the opposite direction.

These and other features of the invention will be understood upon reading of the following description along with the drawings.

DESCRIPTION OF THE PREFERRED EMBODIMENT

Figure 1:
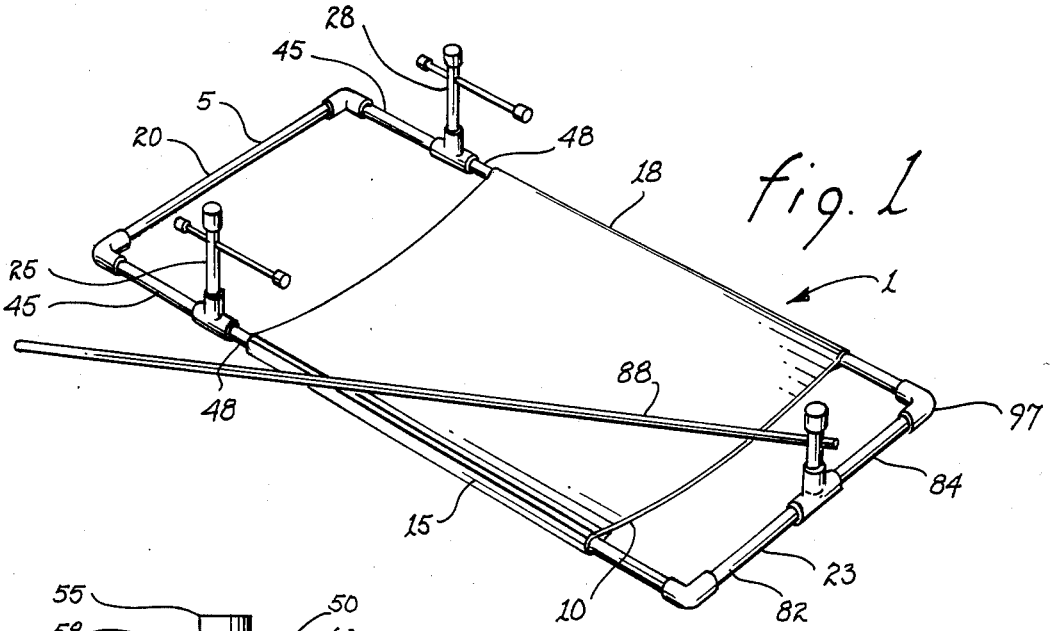
FIG. 1 is a perspective view of one embodiment of an improved apparatus for self-manipulation of spinal vertebrae in accordance with the present invention showing the apparatus ready for use.

FIG. 1 is a perspective view of an improved apparatus for self-manipulation of a spinal vertebrae, generally designated by reference number 1, showing the apparatus ready for use. The frame 5 has a rectangular-shaped member which may be made of a pipe, other tubular members or the like. As shown in FIG. 1, the rectangular member which forms the frame 5 of the apparatus 1 has a body engaging panel 10 which is secured to two sides 15, 18 of the rectangular frame 5, if desired. The panel 10 is, preferably, made out of canvas. For such a design, each side of the panel 10 is wrapped around an adjacent side 15, 18 of the rectangular frame 5 and secured thereto. The panel 10 may also be made out of other types of lightweight, durable, or rigid materials, such as plastic or the like.

Figure 2A:
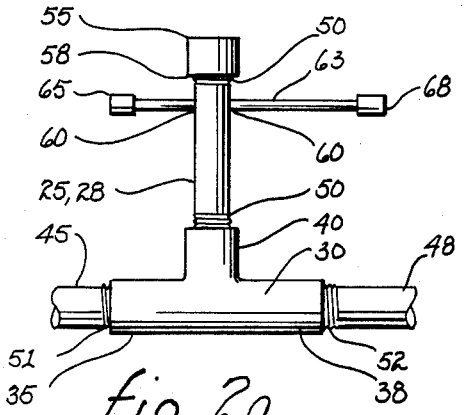
FIG. 2*a* is a side elevational view of a preferred embodiment of a post attached to the upper portion of the apparatus to permit a holddown bar to be mounted thereto for securing the upper torso of a user to efffectively perform the "lumbar roll".

Each elongated member constituting a side 15, 18 which forms a length of the frame 5 has on its designated upper portion a sidepost 25, 28 as illustrated in FIG. 2*a*. A T-shaped coupling 30, having internal threads 33 partially located at the ends of each of its three sides 35, 38, 40, permits elongated members 45, 48 having external threads 51, 52 and forming the side of the frame 5 to be attached thereto. The side post 25, 28 has external threads 50 partially located at both of its end portions. The lower externally threaded end portion of the side post 25, 28 is screwed into the upwardly protruding side 40 of the T-shaped coupling 30. The upper end of the post 25, 28 having external threads 50 permits an end cap 55 having compatible internal threads 58 to be secured and accommodated thereto. The upper portion of the post has apertures 60 to permit a horizontal guide 63 to pass therethrough. The longitudinal axis of the horizontal guide 63 is parallel to the length of the rectangular frame 5. To permit the horizontal guide 63 to be properly secured unto the side post 25, 28, its end portions are externally threaded to accommodate internally threaded caps 65, 68 thereto after insertion of the horizontal guide 63 through the side post apertures 60.

Alternatively, the side 15, 18 which forms the length of the frame 5 may be a full elongated member having external threads located at its end portion. A T-shaped coupling 30 having internal threads only at its upwardly protruding side 40 may be inserted unto one end of the sides 15, 18 to form a base for the side post 25, 28. To properly secure the side post 25, 28 unto the frame 5, the side post 25, 28 is fully screwed into the T-shaped coupling 30 until the lower end of the side post 25, 28 impinges upon the side 15, 18 forming the length of the frame 5.

Figure 2B:
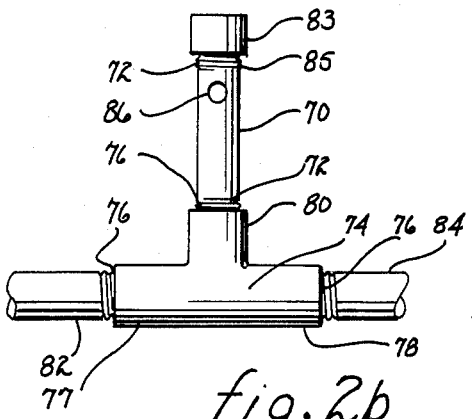
FIG. 2*b* is a side elevational view of a preferred embodiment of a post attached to the lower portion of the apparatus and connected to an associated lever to permit the use of the apparatus to secure his legs and to properly apply directed pressure to himself (in the manner shown in FIG. 5) to effectively perform the "lumbar roll."

As similarly shown in FIG. 2*b*, an end post 70 is attached to the lower portion of the rectangular frame 5. As in previous discussions, a T-shaped coupling 74 having internal threads 76 partially located at the ends of each of its sides 77, 78, 80 permits elongated members 82, 84 forming the lower width of frame 5 to be attached thereto. The end post 70 has external threads 72 partially located at both of its end portions. The lower externally threaded end portion of the end post 70 is screwed into the upwardly protruding side 80 of the T-shaped coupling 74. The upper end of the post 70 having external threads 72 permits an end cap 83 having compatible internal threads 85 to be secured and accommodated thereto. The upper portion of the post 70 has an aperture 86 to permit an elongated lever 88 (see FIG. 1) to be secured thereto. The lever 88 diagonally extends from the end post 70 across the lower portion of the rectangular frame 5 and beyond the external boundary of the rectangular frame 5 as clearly illustrated in FIG. 1.

Figure 3:
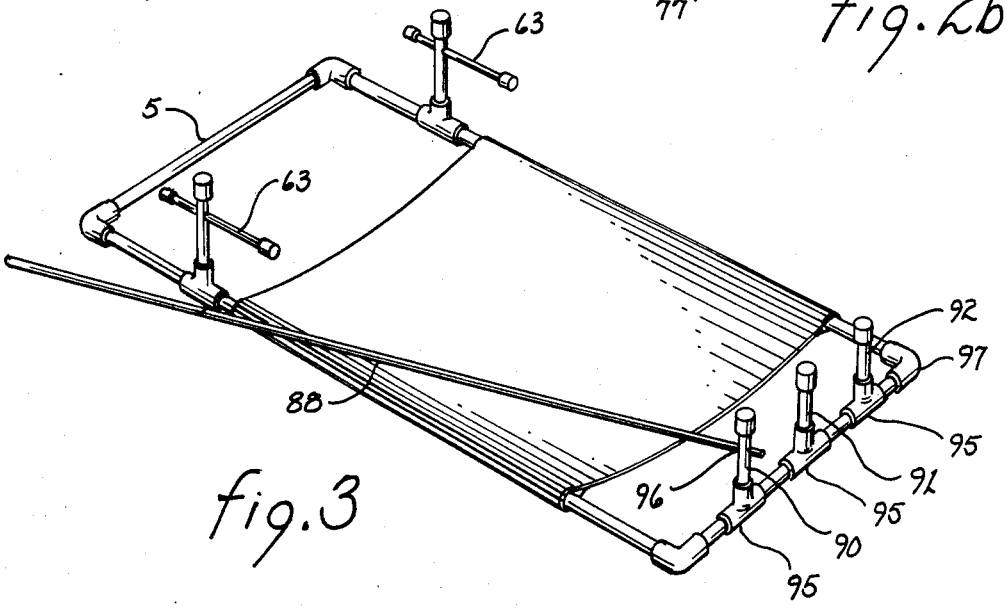
FIG. 3 is a perspective view of an alternative embodiment of the improved apparatus for self-manipulation of a spinal vertebrae showing a plurality of end posts attached to the lower width of the apparatus rectangular frame with an associated lever connected to at least one of the end posts for proper pressure application when the apparatus is in use.

Alternatively, as shown in FIG. 3, the rectangular frame 5 of the apparatus 1 may have a plurality of end posts 90, 91, 92 attached to its lower width. The plurality of end posts 90, 91, 92 are attached to the rectangular frame's 5 lower width by using T-shaped couplings 95 in a similar manner discussed earlier for the side elongated members 15, 18 forming the lengths of the rectangular frame 5. One of the plurality of end posts 90, 91, 92 has an aperture 96 to permit the elongated lever 88 to be secured thereto.

Figure 4:
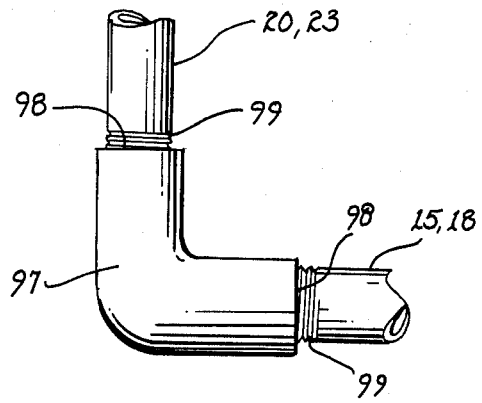
FIG. 4 is a perspective view of one of the corners of the frame showing the coupling joints which connect the sides of the apparatus frame.

The elongated members which partially or fully make up the sides of the frame 5 are connected at the corners by coupling joints 97 as illustrated in FIG. 4. Each coupling joint 97 is in a configuration of an L-shaped tubular member having internal threads 98 partially located at its ends. Each end portion of a side 15, 18, 20, 23 has external threads 99 to permit attachment into the coupling joint 97 having compatible internal threads 98.

Figure 5:
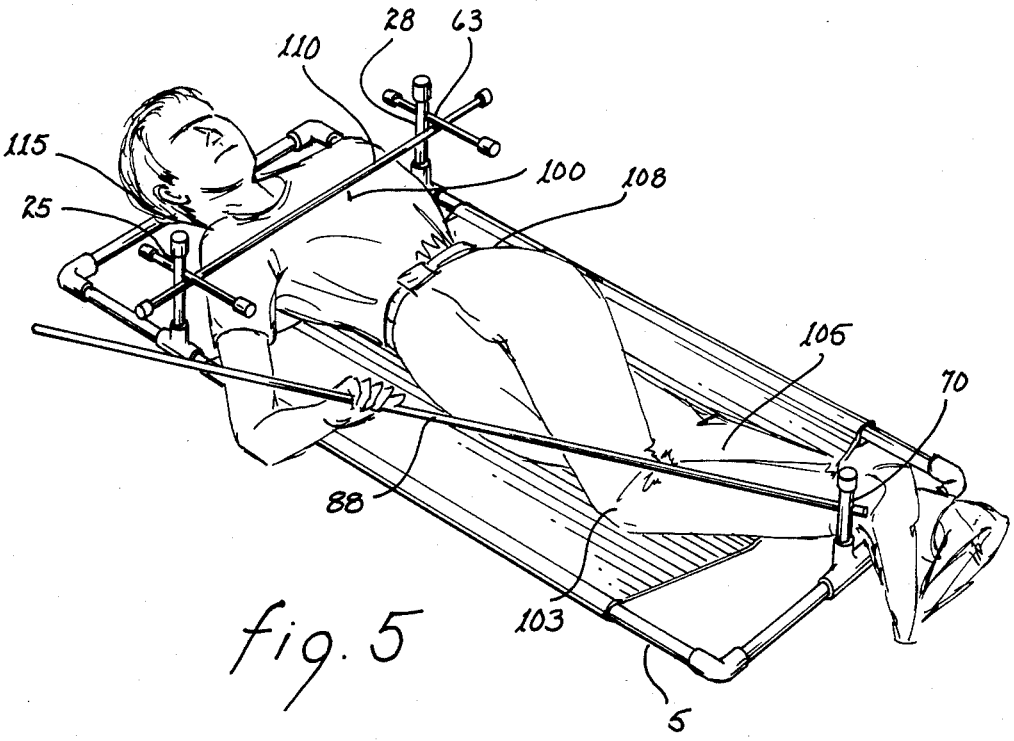
FIG. 5 is a perspective view showing the manner in which the apparatus is used to secure both the upper torso and legs of a user to properly perform the twisting motion essential in executing a "lumbar roll."

Referring now to FIG. 5, the manner in which the apparatus 1 is used to secure both the upper torso 100 and legs 103, 105 of a user 108 to properly perform the twisting motion essential in executing a "lumbar roll" is shown. The horizontal guides 63 attached to the side posts 25, 28 permit an elongated member 110 mounted underneath the horizontal guides 63 to act as a holddown device for the upper torso 100 of a user during his performance of the "lumbar roll." The holddown device permits the shoulders 115 of the user 108 to be pinned down to the rectangular frame 5 to more effectively manuever the twisting motion necessary to manipulate the spinal vertebrae by permitting the user 108 to rotate his lower torso or pelvis in one direction. During the operator's 108 use of the apparatus 1, his legs 103, 105 are preferably located at one side of the centrally located end post 70 so that during his rolling motion, one of his legs 103 is permitted to rest above the other leg 105 and wrapped around the end post 70 as illustrated in FIG. 5, to properly perform the "lumbar roll" manuever. The user 108 may grasp the lever 88 to permit him to apply appropriate pressure to himself for rotating his lower torso or pelvis in one direction while rotating his upper torso 100 (specifically, his shoulders) in the opposite direction, if desired.

The above description is included to illustrate the operation of the preferred embodiments and is not meant to limit the scope of the invention. The scope of the invention is to be limited only by the following claims. From the above discussion, many variations are apparent to one skilled in the art which would yet be encompassed by the spirit and scope of the invention.

I claim:

1. Am improved exercise apparatus for self-manipulating of a spinal vertebrae, comprising:

a frame having a body engaging panel;

removable holddown means mounted to said frame for holding an upper torso of a user to said frame, said removable holddown means comprises a vertical support means connected to an upper portion of said frame for removably mounting a bar, said bar extending across the width of said frame as a holddown for a user's upper torso;

securing means coupled to said frame for allowing said user to properly brace at least one of his legs to said frame;

a long horizontal member acting as a lever means for rotating a user's lower torso relative to the upper torso is attached to said securing means for allowing said user to properly apply directed pressure to himself during exercise maneuvers executing a "lumbar roll";

horizontal guide means attached to said vertical support means for securing said bar;

coupling means for joining said vertical support means to said frame; and caps having internal threads attached to said horizontal guide means to properly secure said horizontal guides to said vertical support means.

2. The improved exercise apparatus of claim 1 wherein said vertical support means further comprising a tubular member having external threads on both ends of said tubular member and an aperture transversely passing through the upper portion of said tubular member to permit said horizontal guide means to be attached thereto.

3. The improved exercise apparatus of claim 1 wherein said horizontal guide means comprises a tubular member having external threads to accommodate said caps.

4. The improved exercise apparatus of claim 1 wherein said coupling means comprises a first T-shaped tubular member having internal threads on three sides.

5. The improved exercise apparatus of claim 1 wherein said frame comprises:

a plurality of tubular members each having external threads on both ends forming the sides of said frame; and a plurality of corner coupling means for joining said tubular members to form said frame.

6. The improved exercise apparatus of claim 5 wherein said corner coupling means comprises an L-shaped tubular member having internal threads on both ends of said L-shaped tubular members to couple the plurality of said tubular members forming the sides of said frame.

7. The improved exercise apparatus of claim 1 wherein said securing means coupled to said frame comprises:

a vertical tubular member having external threads on both ends of said vertical tubular member coupled to the lower portion of said frame and an aperture transversely passing through said vertical tubular member to attach said long horizontal member thereto; and coupling means for joining said vertical tubular member to the lower portion of said frame.

8. The improved exercise apparatus of claim 7 wherein said coupling means comprises a second T-shaped tubular member having internal threads on three sides to permit a plurality of tubular members to be connected to the lower portion of said frame.

9. The improved exercise apparatus of claim 1 wherein said long horizontal member attached to said securing means comprises a tubular member extending diagonally from said securing means to the external boundary of the upper portion of said frame.

* * * * *